US008931920B2

(12) United States Patent
Tessnow

(10) Patent No.: US 8,931,920 B2
(45) Date of Patent: Jan. 13, 2015

(54) OPTIC FOR AN LED ARRAY

(75) Inventor: Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 873 days.

(21) Appl. No.: 12/657,164

(22) Filed: Jan. 14, 2010

(65) Prior Publication Data

US 2011/0170286 A1 Jul. 14, 2011

(51) Int. Cl.

| | |
|---|---|
| ***F21S 4/00*** | (2006.01) |
| ***F21V 21/00*** | (2006.01) |
| ***F21V 7/00*** | (2006.01) |
| ***F21V 7/06*** | (2006.01) |
| ***F21S 8/10*** | (2006.01) |
| *F21Y 103/00* | (2006.01) |
| *F21Y 101/02* | (2006.01) |

(52) U.S. Cl.

CPC ..... *F21V 7/0083* (2013.01); *F21V 7/06* (2013.01); *F21S 48/1154* (2013.01); *F21S 48/1335* (2013.01); *F21Y 2103/003* (2013.01); *F21Y 2101/02* (2013.01)

USPC ..... 362/249.02; 362/296.08; 362/235; 362/543; 362/516

(58) Field of Classification Search

USPC ..... 362/249.02, 800, 235, 296.01, 296.08, 362/543–545, 514, 516

See application file for complete search history.

(56) References Cited

U.S. PATENT DOCUMENTS

| | | | | |
|---|---|---|---|---|
| 4,792,717 | A | 12/1988 | Ferenc | |
| 6,318,886 | B1 | 11/2001 | Stopa et al. | |
| 6,641,284 | B2 | 11/2003 | Stopa et al. | |
| 7,128,453 | B2 * | 10/2006 | Tatsukawa et al. | 362/507 |
| 7,572,030 | B2 | 8/2009 | Booth et al. | |

(Continued)

FOREIGN PATENT DOCUMENTS

| | | | |
|---|---|---|---|
| JP | 200357500 | A | 2/2003 |
| JP | 2006128041 | A | 5/2006 |

(Continued)

OTHER PUBLICATIONS

Espacenet Patent Abstract of Japanese Publication No. 2006-128041, Publication Date: May 18, 2006, 1 page.

(Continued)

*Primary Examiner* — Britt D Hanley
*Assistant Examiner* — Jessica M Apenteng
(74) *Attorney, Agent, or Firm* — Edward S. Podszus

(57) ABSTRACT

A light assembly (100) for directing light into a light guide utilizes a light source (120) comprising a linear array of light emitting diodes (140). The linear array has two opposed long sides (160, 180) equally disposed about a longitudinal axis (162) and two opposed short sides (200, 220) and is positioned in a mounting plane (240). The array has an optical plane (250) lying in a plane perpendicular to the mounting plane (240). A primary optic (260) having a reflecting surface (270) is associated therewith, the reflecting surface (270) having a parabolic cross-section and a focal point (280) and a bisector of parabolic cross-section (282) wherein the focal point (280) is disposed at one of the long sides (160, 180) of the array (140) and the bisector of parabolic cross-section (282) has an axis (283) that is tilted with respect to the optical plane (250). In a preferred embodiment, the axis (283) of the bisector of parabolic cross-section (282) is tilted about 8 degrees. The construction provides an arrangement for feeding light from the array into a light guide.

12 Claims, 13 Drawing Sheets

(56) References Cited

U.S. PATENT DOCUMENTS

| | | | | |
|---|---|---|---|---|
| 8,071,990 | B2 | 12/2011 | Bogner et al. | |
| 2003/0156416 | A1 | 8/2003 | Stopa et al. | |
| 2006/0239006 | A1 | 10/2006 | Chaves et al. | |
| 2008/0117647 | A1 | 5/2008 | Behr et al. | |
| 2009/0001490 | A1 | 1/2009 | Bogner et al. | |
| 2009/0168395 | A1 * | 7/2009 | Mrakovich et al. | 362/84 |
| 2009/0185389 | A1 | 7/2009 | Tessnow | |

FOREIGN PATENT DOCUMENTS

| | | | |
|---|---|---|---|
| JP | 2008507850 | A | 3/2008 |
| WO | 2006096467 | A2 | 9/2006 |
| WO | 2009031240 | A1 | 3/2009 |

OTHER PUBLICATIONS

Espacenet Patent Abstract of Japanese Publication No. 2003-057500, Publication Date: Feb. 26, 2003, 1 page.

Machine generated English translation of Japanese Patent Application No. 2003-57500, 16 pages.

Machine generated English translation of Japanese Patent Application No. 2006-128041, 9 pages.

Espacenet Patent Abstract of WO2006012842, Publication Date Feb. 9, 2006, based on Japanese Patent Application 2008-507850, 1 page.

* cited by examiner

OPTIC FOR AN LED ARRAY

CROSS-REFERENCE TO RELATED APPLICATIONS

None.

GOVERNMENT CONTRACT

This invention was not made under any government contract and the United States Government has no rights under this invention.

TECHNICAL FIELD

This invention relates to light sources and more particularly to light sources utilizing light emitting diodes (LED or LEDs). Still more particularly, it relates to a light source employing an optic for focusing light emitted from the LEDs into a light guide for distribution to a remote location.

BACKGROUND ART

An increasing number of lighting applications have been developed utilizing LEDs because of their ruggedness (they are solid state devices), their compactness, their low power requirements and their long life. Foremost among these light applications have been the light sources used in automotive vehicles; namely, center high mount stop lights (CHMSL) and tail and brake lights. In some applications the LEDs are suitable for use as direct-view light sources, comparable to the S8 filamented lamps they replace. However, in other applications it is desirable to collect the light from the light source and concentrate and/or focus it so that it can be directed to a remote location, for example, via a light guide. Light guides do not focus or concentrate the light received by them, but merely direct it to another location. It has long been known that an optic with a parabolic surface generated by the standard formula, $Z=\frac{1}{4}f\cdot R^2$, such as those used in PAR lamps, is an efficient concentrator of light and such devices have been used in the past with light emitting diodes; however, generally, each light emitting diode was utilized with an individual optic, a costly and difficult procedure compounded by alignment issues. It has been proposed to utilize a single optic with an array of LEDs for purposes of automotive headlamps, wherein a high luminance, a narrow radiation angle and a well-defined shape of radiation is used. See US Published Patent Application No 2009/0001490 A1 (Bogner, et al.). Also, direct importation of light from LEDs into a light guide or guides is known in US Published Patent Application No. 2009/0185389 A1 (Tessnow, et al.), which application is assigned to the assignee of the instant invention.

Adaptation of parabolic optics for leading light into light guides has, however, proven difficult, particularly when involving a linear array of LEDs. For example, it has been know to use a single glass compound parabolic concentrator (CPC) for each LED in a 2×3 chip array; however, such a system does not work well with a tightly spaced linear array.

Additionally, utilizing a linear array of LEDs has also proven difficult. Beginning with a linear array, one is generally limited to a particular entrance, the size of the entrance, of course, being dictated by the physical dimensions of the array itself. Developing a specific exit aperture for such an array, using a conventionally oriented CPC, has been found not practicable.

DISCLOSURE OF INVENTION

It is, therefore, an object of the invention to enhance LED light sources.

Yet another object of the invention is the improvement of LED light sources for feeding light into a light guide.

Still another object of the invention is the provision of an optic for use with a linear array of LEDs.

These object are accomplished, in one aspect of the invention, by the provision of a light assembly for directing light into a light guide, the light assembly comprising a light source having a linear array of light emitting diodes, the linear array having two opposed long sides equally disposed about a longitudinal axis and two opposed short sides and being positioned on a mounting plane and having an optical axis lying in a plane perpendicular to the mounting plane. An optic, which can a primary optic, is provided about the LEDs and has a reflecting surface associated therewith. The reflecting surface has a parabolic cross-section and a focal point and a bisector of parabolic cross-section wherein the focal point is disposed at one of the long sides of the linear array and the bisector of parabolic cross-section has an axis that is tilted with respect to the optical axis. Such a structure provides a CPC device for introducing light into a light guide. Additionally, such a structure provides an optic that has a 20 degree emission into both directions perpendicular to the optical axis, which is very efficient for emission into light guides. The parabolic cross-section need not be a true, smooth parabola, but can be approximated by polygonal or linear segments that collectively lie tangent to a parabolic cross-section.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
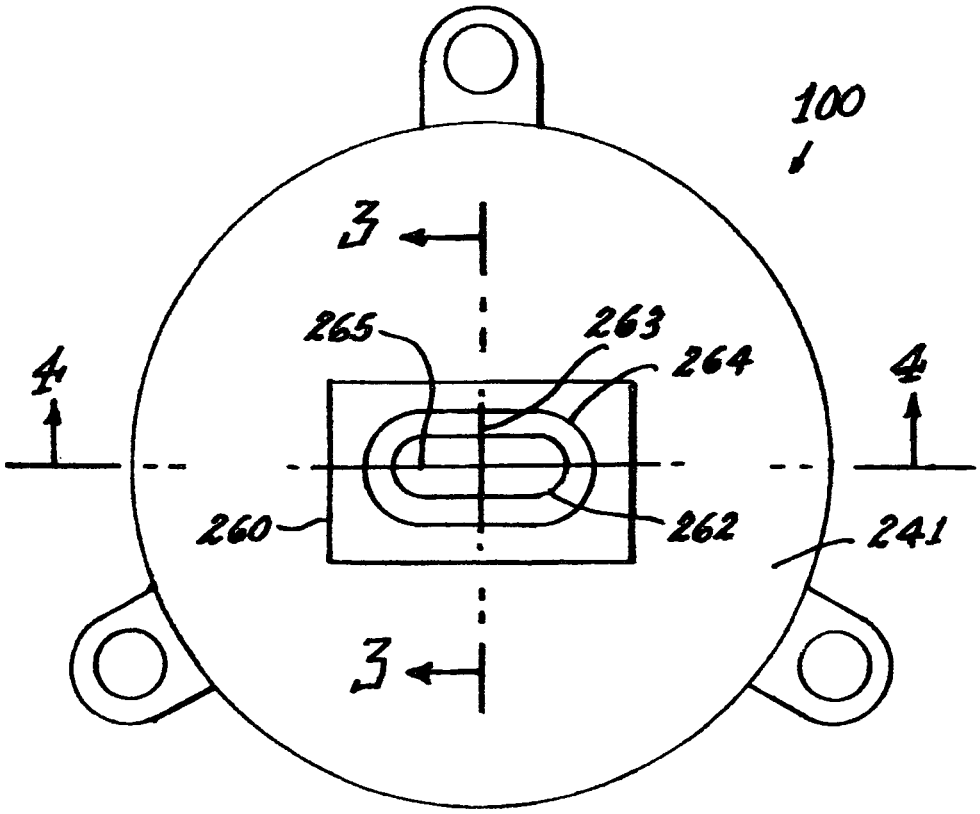
FIG. 1 is a plan view of a light assembly according to an aspect of the invention.
Figure 2:
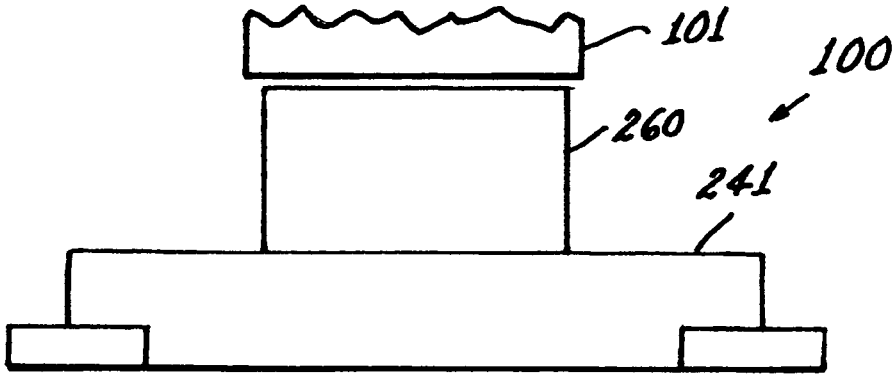
FIG. 2 is an elevation view thereof.
Figure 5:
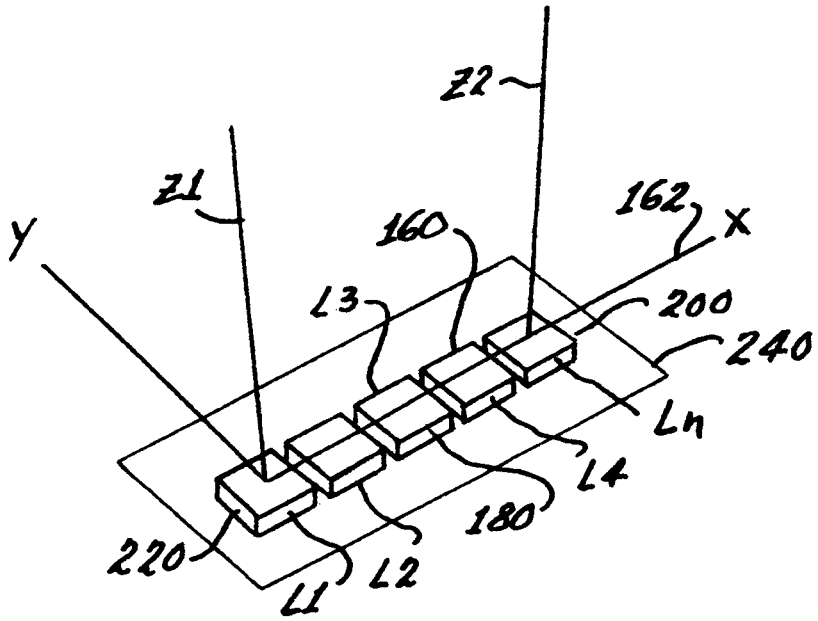
FIG. 5 is a diagrammatic, perspective view of an LED array.
Figure 8:
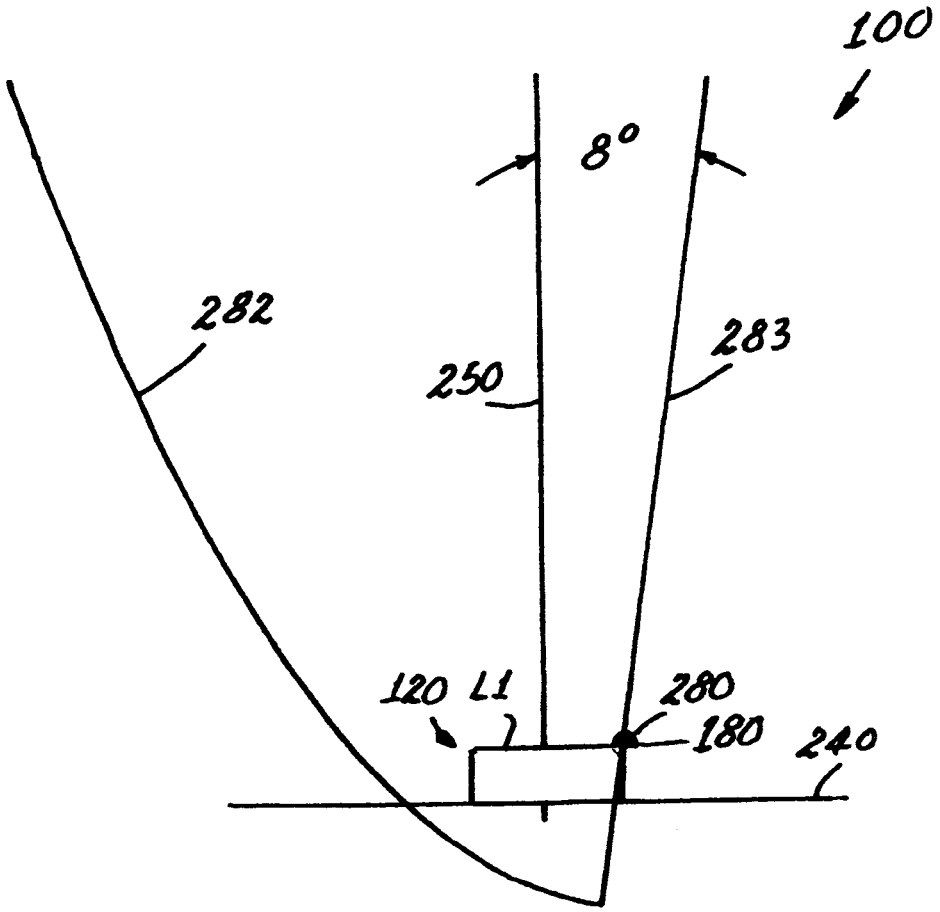

Referring now to the drawings with greater particularity there is shown in FIGS. 1 and 5 a light assembly 100 for directing light into a light guide 101. A light source 120 is comprised of a linear array of multiple LEDs 140 having two opposed long sides 160, 180 disposed, preferably equally disposed, about a longitudinal axis 162 and two opposed short sides 200, 220 and being positioned in a mounting plane 240 and having a median optical plane 250 lying in a plane perpendicular to the mounting plane 240. In the embodiment shown in FIG. 5 there are five LEDs in one row, labeled L1-Ln. The mounting plane 240 is preferably the upper surface 241 of a commercially available light source, such as a JFL2, available from Osram GmbH, Munich, Germany. An optic 260 is provided adjacent the LEDs and has a reflecting surface 270 associated therewith, the reflecting surface 270 having a parabolic cross-section and a focal point 280 and a bisector of parabolic cross-section 282 wherein the focal point 280 is disposed at one of the long sides 160, 180 and the bisector of parabolic cross-section 282 has an axis 283 that is tilted with respect to the optical axis 250. This feature is illustrated in FIG. 8.

In a preferred embodiment the axis 283 of the bisector of parabolic cross-section 282 is tilted about 8 degrees and the linear array of LEDs 140 has 5 LEDs.

The optic 260 can be formed from a suitable metal, for example, aluminum or stainless steel, or it can be formed from a high temperature plastic such as an acrylonitrile butadiene styrene (ABS) material, with the parabolic surface 270 appropriately reflectorized. In a preferred embodiment of the invention, the optic 260 is fabricated from aluminum; however, it will be understood by those skilled in the art that the ultimate choice of material for the optic will depend upon many factors, not the least of which are cost of the materials and the environmental conditions existing where the optic is being used.

In a preferred embodiment, when the optic 260 is used with the light source described above, the optic 260 can have exit window dimensions of about 10 mm by about 14.40 mm along axes 263, 265 respectively.

Figure 3:
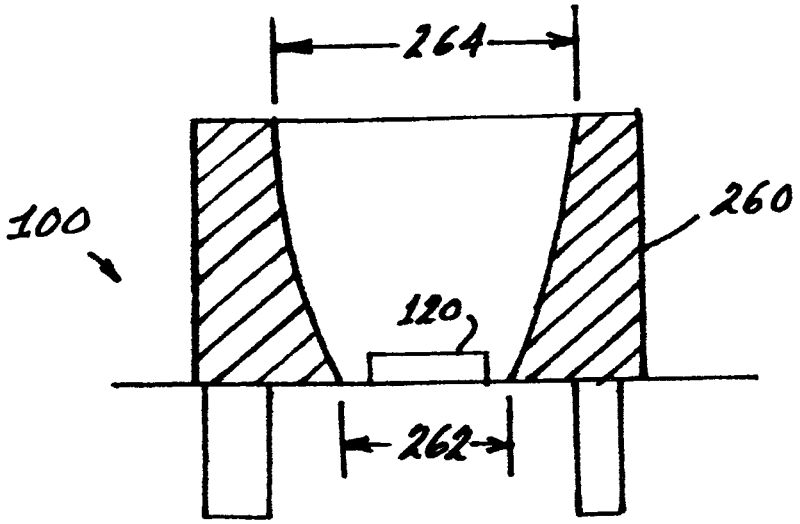
FIG. 3 is a sectional view taken along the line 3-3 of FIG. 1.
Figure 4:
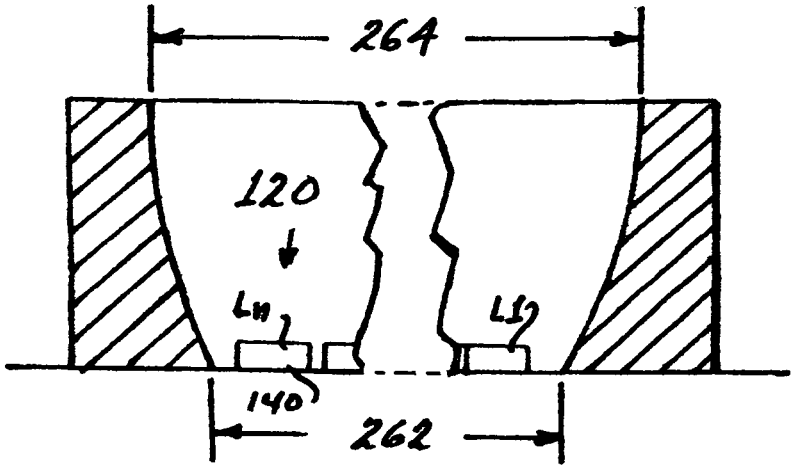
FIG. 4 is a sectional view taken along the line 4-4 of FIG. 1.

Referring particularly to FIGS. 3 and 4, the optic 260 has an entrance window 262 and exit window 264, each of the windows being generally oval and having a short axis 263 and a long axis 265, the short axis of the exit window 264 being from 3.046 to 3.05 times larger than the short axis of the entrance window 262 and the long axis 265 of the exit window 264 being about 1.875 times larger than the long axis of the entrance window 262.

A method of generating a parabolic surface 270 for use with the low profile optic 260 for use with a linear array of multiple LEDs 140 (L1-Ln) is sequentially illustrated in FIGS. 5-12.

Referring now to FIG. 5 there is illustrated in accordance with a preferred embodiment of the invention a linear array of five LED chips 140, designated L1 to terminal (or last) LED Ln, where "n" equals 5. The chips are each 1 mm×1 mm in size and have a 0.1 mm gap between them. The LEDs are arranged in one row. The row could have more, or less, LEDs than the five LEDs illustrated. The light emitted from such chips provides a lambertian pattern directed toward the Z axis. For the construction shown herein there are defined two Z axes, Z1 and Z2, which are located respectively at the center of chips L1 and the final LED in the array Ln.

Figure 6:
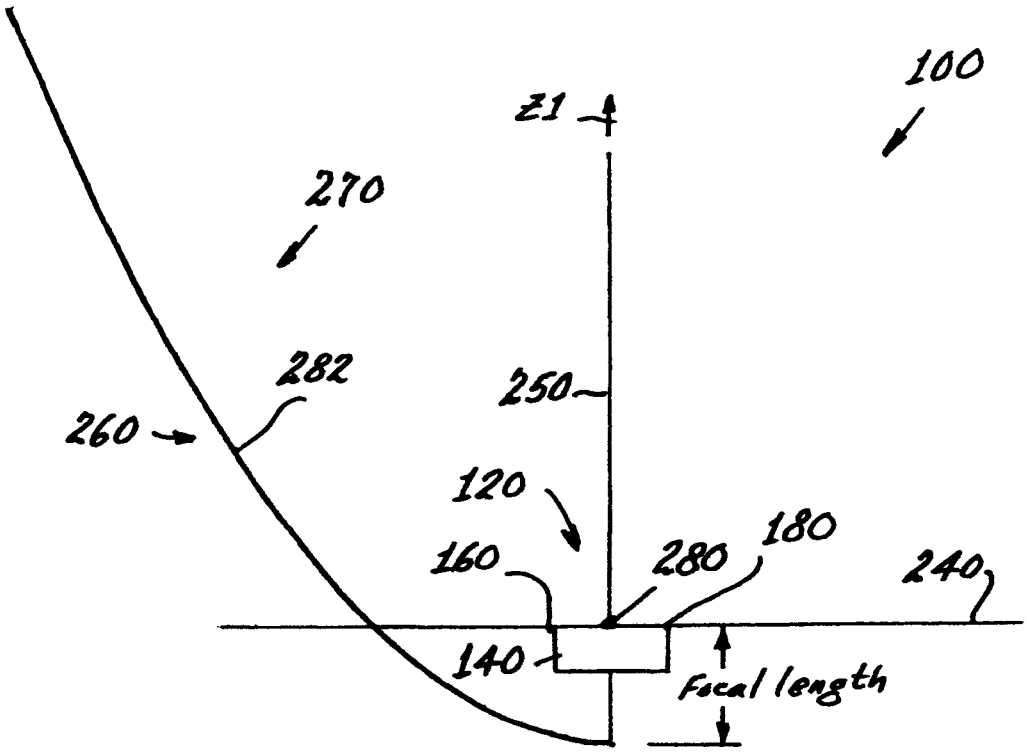
FIGS. 6-12 are diagrammatic representations in steps of preparing a parabolic surface according to an aspect of the invention.

A bisector of the parabolic cross-section 282 is created in the Z-Y plane with a focal length of 1 mm and a focal point 280 in the center of LED L1 and the axis 283 of the bisector of the parabolic cross-section 282 is aligned parallel to the axis Z1, as shown in FIG. 6.

Figure 7:
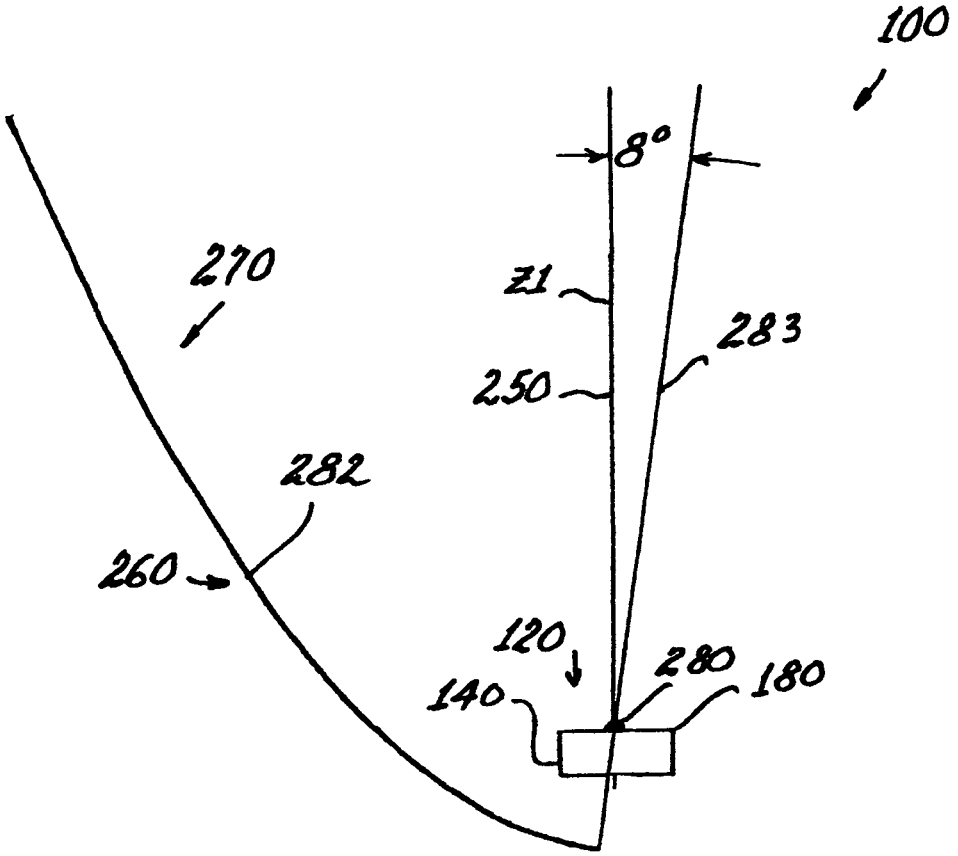

The axis 283 of the bisector of the parabolic cross-section 282 is tilted about the focal point 280 inwardly away from the axis Z1 and in a preferred embodiment, that tilt is 8 degrees, as shown in FIG. 7.

Figure 9:
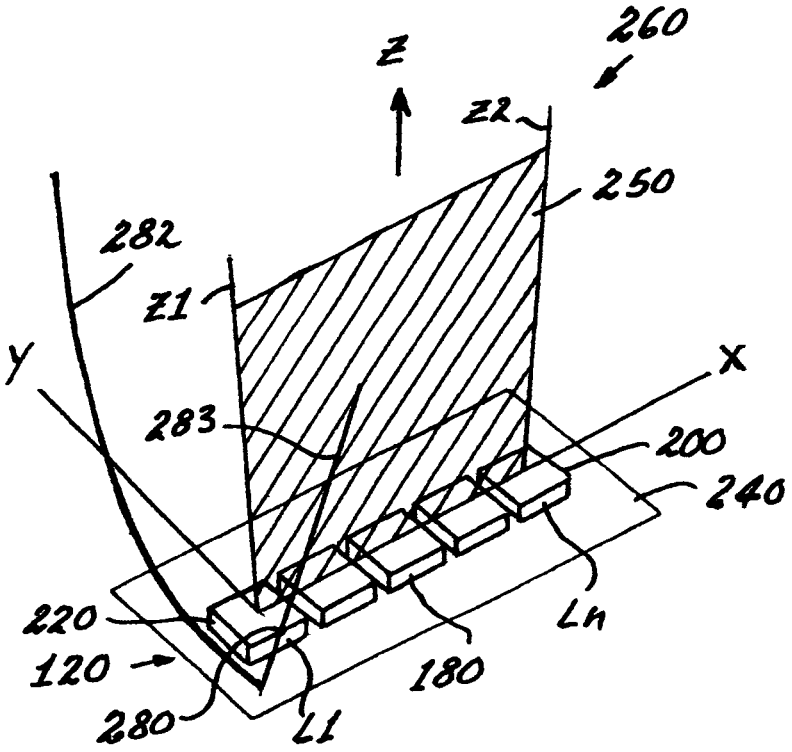
Figure 10:
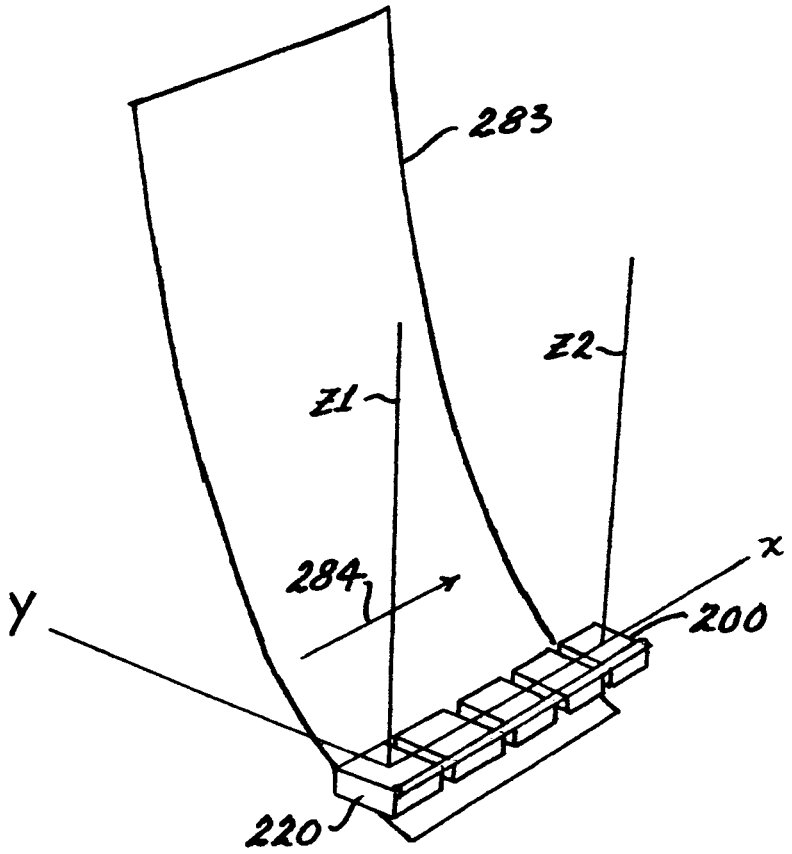

The axis 283 of the bisector of parabolic cross-section 282 is then shifted along the Y axis by one half the width of LED L1 so that the focal point 280 lies on the long edge 180 of the LED array 120, as shown in FIGS. 8 and 9.

Figure 11:
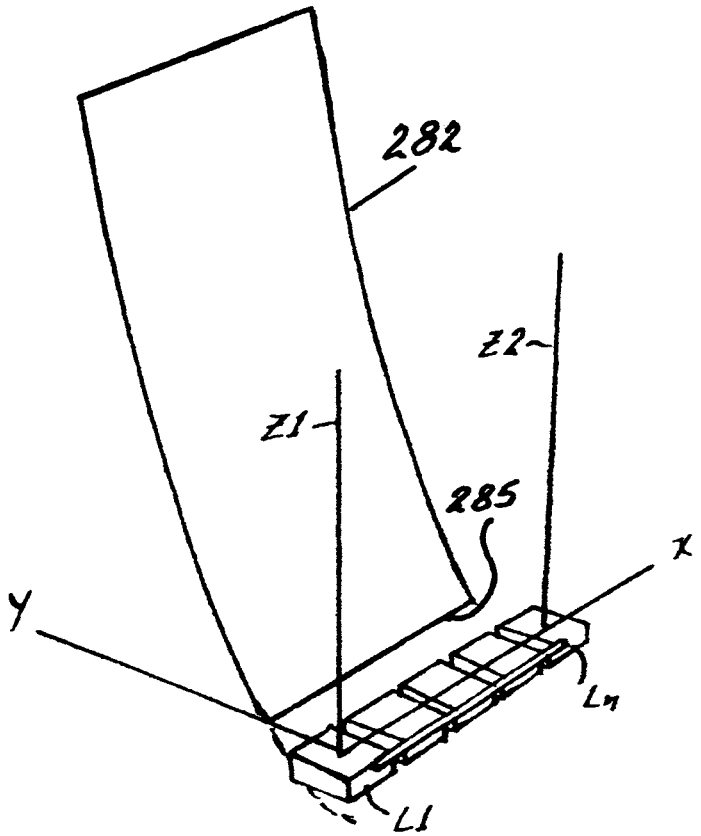
Figure 12:
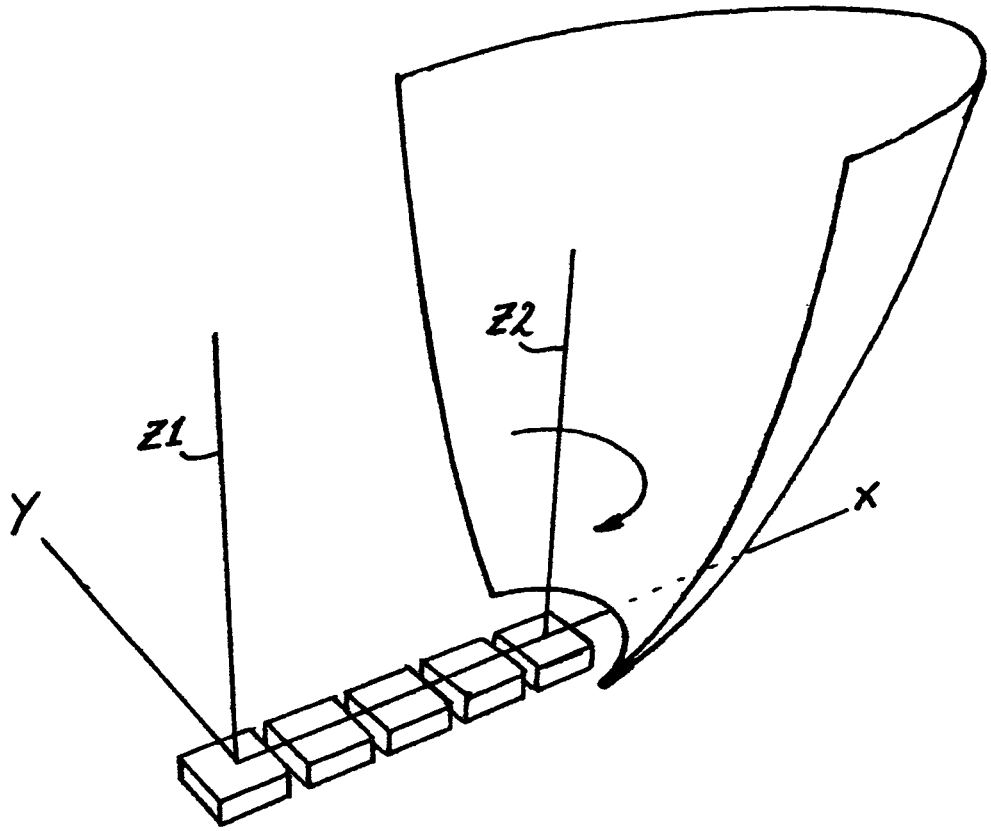

The bisector of parabolic cross-section 282 is then swept along the X axis from the center of LED L1 to the center of the last or terminal LED Ln, which has axis Z2, in the direction of arrow 284 (FIG. 10) to the center of LED chip Ln and then has the bottom portion trimmed away as shown in FIG. 11, whereby the bottom edge 285 is at an even height with the top surface of the LEDs 140.

The bisector of parabolic cross-section 282 is then rotated around the axis Z2 to form one half of the surface 270. These actions are then duplicated along the other long side 160 and axis Z1 to complete the parabolic surface 270, which is shown completely in FIGS. 1, 3 and 4.

Figure 13:
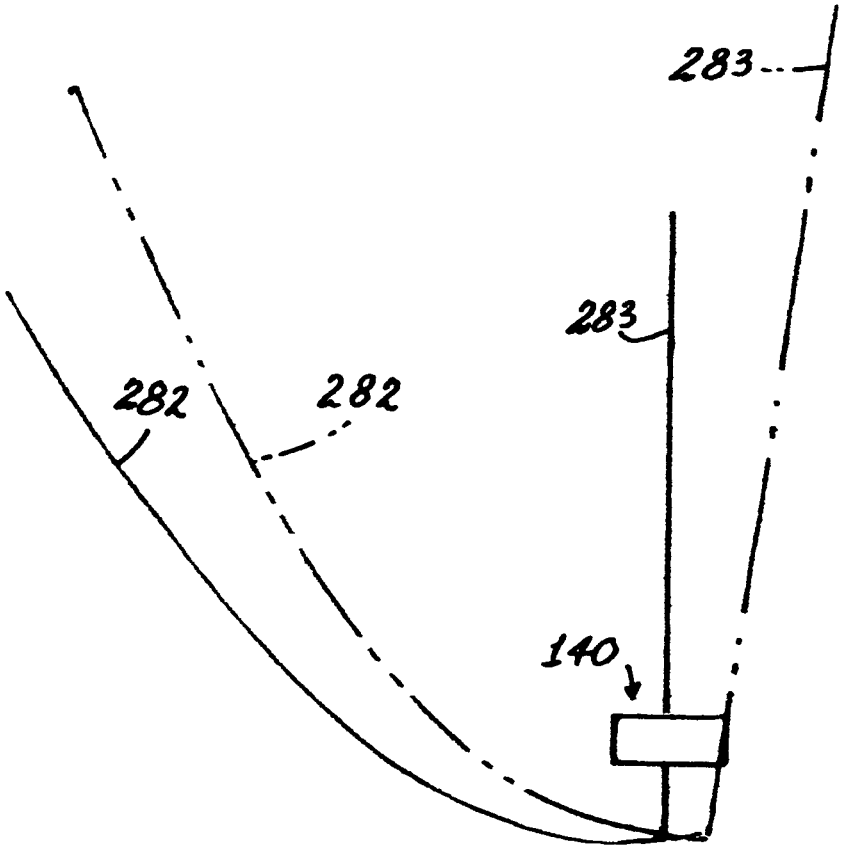
FIG. 13 is a diagrammatic view comparing a conventionally developed parabolic cross-section with one developed utilizing an aspect of the instant invention.
Figure 14:
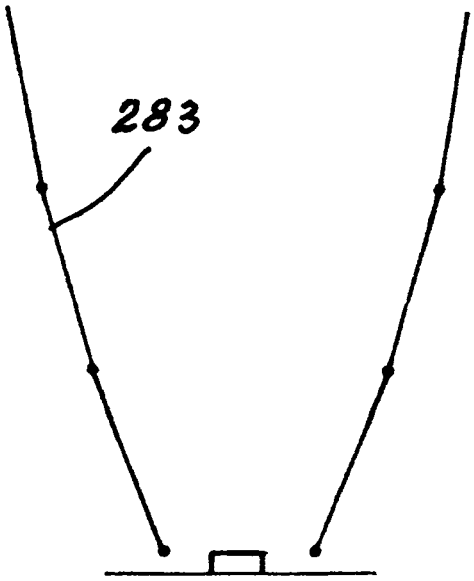
FIG. 14 is a diagrammatic illustration of an alternate embodiment of the invention.

FIG. 13 provides a diagrammatic illustration of the differing proportions provided by the invention as compared to the original generation. In FIG. 13 the original generation is shown in solid lines and the bisector of parabolic cross-section of an aspect of the invention is shown in the dashed lines.

The optic 260 as constructed herein will provide, among other capabilities, a 20 degree emission into both directions perpendicular to the optical axis and an approximately 30% reduction in the width of the exit aperture, which is convenient for providing optimal coupling to a light guide.

Figure 15:
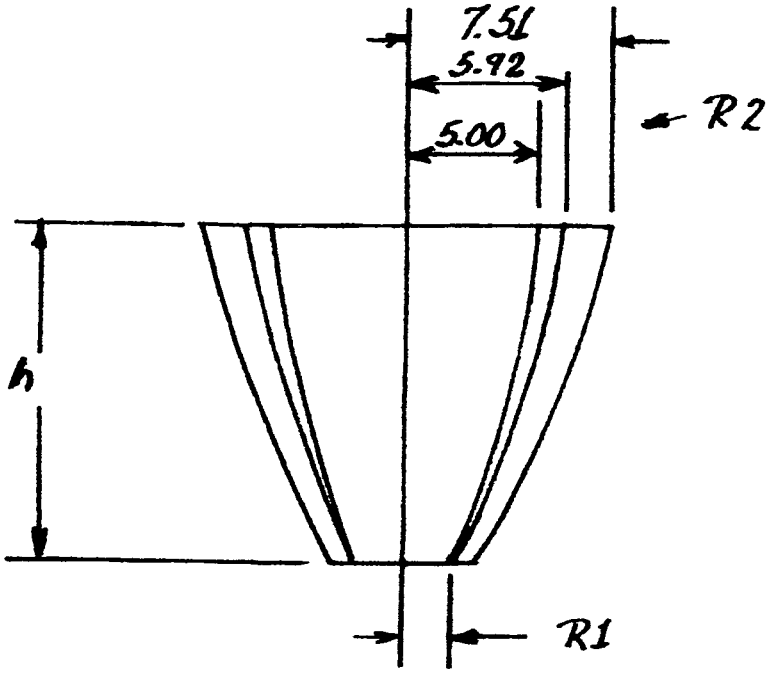
FIGS. 15 and 16 diagrammatically illustrate a specific embodiment of the invention.
Figure 16:
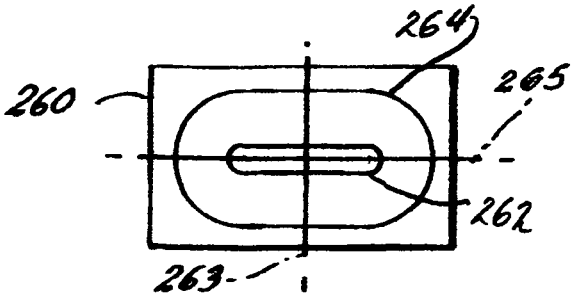

An embodiment of the invention is shown in FIGS. 15 and 16 compared to a conventional, unfitted, unshifted parabolic CPC, wherein an optic 260 has a height "h" of 12.61 mm, a focal length "f" of 1 mm, and entrance radius of 1.64 mm and a desired exit radius of 5.00 mm. The length (L) of the straight section between the two radii of 5.00 at each end is 4.40 mm. The exit window, therefore, has an area "A" equal to $2 \cdot R2 \cdot L + \pi \cdot (R2)^2$.

FIG. 15 thus illustrates three profiles: an embodiment of the invention wherein R2=5 mm; a prior art-type untilted/unshifted parabola utilizing the same focal length but with R2=7.51 mm (which also produces a larger entrance area); and a prior art-type untilted/unshifted parabola, but with F=0.64.

Accordingly, utilizing this example it can be calculated that with the design according to an embodiment of the invention and R2=5 mm and L=4.40 mm, the exit window area A=122.5 $mm^2$. The exit aperture has a size of 10 mm by 14.4 mm. Additionally, the entrance window has an area R1=1.64 mm and L=4.4 mm and an entrance area A=22.88 $mm^2$; providing an area ratio whereby the exit area is 5.35 times as large as the entrance area for a height h=12.61 mm, or generally in a range of about 5.2 to about 5.4 times as large as the entrance area. This ratio is not achievable without the tilt and shift of this invention for this height.

In contrast, for an untilted/unshifted (which may be called "straight forward") parabola with the same length and focal length and R2=7.51 mm, the exit window area A=243.3 $mm^2$ and for an untilted/unshifted parabola with the same entrance area and R2=5.92 mm, resulting in an exit aperture of 11.84 mm by 16.24 mm, the exit window area A=162.2 $mm^2$. Thus, it will be seen that utilizing the shift and tilt of the parabolic axis of the invention allows an exit window area that is 30% to 50% smaller than a conventional parabola.

It was considered that by using an approximately 10 mm×15 mm plastic CPC whose parabolic reflector surface was not tilted and translated as described hereinabove, that is, for example, one with a focal length of 0.434 mm centered on the chip surface at Z=0, one could use the small area as the light entrance from an array of LEDs and the large area as the emission region, but that implicated going from a large divergence angle at the entrance to a small divergence angle on the emission side and the primary optic would have to be carefully aligned with the entry to the light guide and the light guide's dimensions would have to be carefully controlled to tight tolerances; conversely if one used the large opening as the light entrance and passed the light to the smaller area, then the divergence of the light goes from a small angle to a large angle, and if light is sent at a large angle to a light guide, the light might miss the entry to the light guide. It is known that one obtains more efficiency when light goes in perpendicular to a surface, which involves about a 4% loss, in comparison to about 20% loss when light entry is at 45 degrees. If a CPC that is tilted and translated as described above is not used, then in order to more tightly control the light emission a plastic molded CPC could simply be made smaller but on the size scale involved here to inject light into a typical 10 mm×15 mm cross sectional entry area of a light guide, then the use of an inexpensive 1-shot mold process can result in sinks in the plastic, which leads to light loss; alternatively a carefully controlled molding could be made using so-called two-layer molding but that process is expensive. The use of the CPC tilted and translated as described brought the surprising advantage that one can put up with larger tolerances on the light guide, which is typically made of molded plastic for low-cost, mass produced automotive lamps, or on the alignment of the emission region of the CPC to the light guide.

While there have been shown and described what are at present considered to be the preferred embodiments of the invention, it will be apparent to those skilled in the art that various changes and modifications can be made herein without departing from the scope of the invention as defined by the appended claims.

Glossary of Reference Numerals Used Herein

100 light assembly
101 light guide
120 light source
140 light emitting diodes
L1 first diode
L2 second diode
L3 third diode
L4 fourth diode
Ln fifth diode
160 first long side of diode array
180 second long side of diode array
200 first short side of diode array
220 second short side of diode array
240 mounting plane
250 median optical plane
260 primary optic
262 entrance window
264 exit window
270 reflective surface of 260
280 focal point
282 bisector of parabolic cross-section
283 axis of parabolic cross-section
284 arrow indicating first direction of sweep
285 bottom edge of 282

What is claimed is:

1. A light assembly (100) comprising:

a light source (120) comprising a linear array of a plurality of light emitting diodes (140), said linear array having two opposed long sides (160, 180) disposed about a longitudinal axis (162) and two opposed short sides (200, 220) and being positioned in a mounting plane (240) and having a median optical plane (250) perpendicular to said mounting plane (240), and a primary optic (260) having a reflecting surface (270), said reflecting surface (270) comprising two mutually inclined portions, each portion approximating a parabolic cross-section and having a focal point (280) and a bisector of the parabolic cross-section (282) wherein said focal point (280) is disposed at one of said long sides (160, 180) and said bisector of the parabolic cross-section (282) has an axis (283) that is tilted away from said median optical plane (250).

2. The light assembly of claim 1 wherein each portion of said reflective surface (270) comprises a surface congruent to a parabola.

3. The light assembly of claim 1 wherein each portion of said reflective surface (270) comprises linear segments tangential to a parabolic cross-section.

4. The light assembly of claim 1 wherein each portion of said reflective surface is defined by a parabola having the equation $b=\frac{1}{4}f\cdot a^2$, where b represents a distance along a vertical b-axis perpendicular to and centered on an entrance aperture, f represents a focal length, and a represents a distance along an axis orthogonal to the b-axis.

5. The light assembly (100) of claim 4 wherein said portion adjacent said short side (200, 220) joins opposing portions of said reflecting surface (270) that are disposed along the respective long sides (160, 180) of the array.

6. The light assembly (100) of claim 1 wherein the reflecting surface (270) comprises a portion adjacent a said short side (200, 220) defined by a trace of a rotation of said tilted bisector of the parabolic cross-section (282) about an axis (Z2) constructed through a center of a terminal LED (Ln) normal to the mounting plane (240).

7. The light assembly (100) of claim 1 wherein a line connecting centers of a first LED (L1) and a terminal LED (Ln) lies in the plane of the optical plane (250).

8. The light assembly (100) of claim 1 wherein said axis (283) of said bisector of parabolic cross-section (282) is tilted about 8 degrees.

9. The light assembly (100) of claim 1 wherein said linear array comprises five LEDs.

10. The light assembly (100) of claim 1 wherein said primary optic (260) comprises metal.

11. The light assembly (100) of claim I wherein said primary optic (260) comprises a plastics material with a reflective surface (270).

12. A light assembly (100) comprising:

a light source (120) comprised of a linear array of light emitting diodes (140), said linear array having two opposed long sides (160, 180) and two opposed short sides (200, 220) and being positioned in a mounting plane (240) and having an optical plane (250) lying in a plane perpendicular to said mounting plane (240); and an optic (260) having a focal point (280) and positioned relative said light source (120) such that said focal point (280) is offset from said optical plane (250) and is adjacent one of said long sides (160, 180).

* * * * *